US006471531B2

(12) United States Patent
Kanesashi

(10) Patent No.: US 6,471,531 B2
(45) Date of Patent: Oct. 29, 2002

(54) SOCKET FOR ELECTRIC PART

(75) Inventor: Hokuto Kanesashi, Kawaguchi (JP)

(73) Assignee: Enplas Corporation, Saitama (JP)

( * ) Notice: Subject to any disclaimer, the term of this patent is extended or adjusted under 35 U.S.C. 154(b) by 0 days.

(21) Appl. No.: 09/801,294

(22) Filed: Mar. 7, 2001

(65) Prior Publication Data

US 2001/0027046 A1 Oct. 4, 2001

(30) Foreign Application Priority Data

Mar. 16, 2000 (JP) ..... 2000-073463

(51) Int. Cl.[7] ..... H01R 11/22
(52) U.S. Cl. ..... 439/268; 439/263; 439/331
(58) Field of Search ..... 439/266, 268, 439/342, 331, 856, 261, 265, 267, 259, 263

(56) References Cited

U.S. PATENT DOCUMENTS 4,350,402 A * 9/1982 Douty et al. ..... 439/268
4,836,798 A * 6/1989 Carter ..... 439/286
5,213,530 A * 5/1993 Uratsuji ..... 439/268
5,252,097 A * 10/1993 Lindeberg et al. ..... 439/856
5,556,293 A * 9/1996 Pfaff ..... 439/266
6,045,381 A * 4/2000 Walkup et al. ..... 439/259
6,126,467 A * 10/2000 Ohashi ..... 439/268
6,168,449 B1 * 1/2001 Huang et al. ..... 439/259

* cited by examiner

*Primary Examiner*—Hien Vu
*Assistant Examiner*—Felix O. Figueroa
(74) *Attorney, Agent, or Firm*—Koda & Androlia

(57) ABSTRACT

In a socket for an electric part, contact pin-operating bores 12 are provided in a slide plate 10 for opening contact pins 3, and operating grooves 14 are defined in the slide plate 10 and each have a tapered face 16. Operating arms 25 are disposed on an operating member 21 adapted to be engaged into the operating grooves 14 in the slide plate 10, so that the tapered faces 16 of the operating grooves 14 are urged by the operating arms 25 by urging the operating member 21 downwards, thereby directly moving the slide plate 10. Thus, the slide plate can be moved by a simple structure, and the socket can be manufactured easily and at a lower cost. In addition, the stability of contact of the contact pins with terminals can be enhanced.

1 Claim, 5 Drawing Sheets

SOCKET FOR ELECTRIC PART

BACKGROUND OF THE INVENTION

1 Field of the Invention

The present invention relates to a socket for an electric part, and more particularly, to a socket for an electric part for electrically connecting terminals of the electrical part to a printed wiring board of a measurer.

2 Description of the Related Art

In order to carry out the performance test of an electric part such as a semiconductor device or the like, a socket for an electric part for providing an electric connection of terminals of the electric part with an external electric test circuit is conventionally used in many cases.

In such a socket for an electric part, a positioning plate is disposed on a socket body, so that the electric part is placed on the positioning plate. Contact pins are disposed on the socket body, and a slide plate slidable in a horizontal direction is disposed between the positioning plate and the socket body. Further, an operating member for moving the slide plate is disposed for vertical movement relative to the socket body.

In this socket, the slide plate is slid in the horizontal direction through a link mechanism by lowering the operating member, thereby resiliently deforming one of resilient pieces of a contact pin to open upper ends of the resilient pieces. Thereafter, an electric part is placed on the positioning plate, and the operating member is lifted, thereby moving the slide plate back to its original position to release an urging force on the contact pin. This permits the contact pin to be returned to its initial position under its resilient force, whereby the tip ends of the contact pins clamp terminals of the electric part and as a result, the electric connection of the electric part is achieved.

However, such conventional socket for the electric part suffers the following problem: Since the slide plate is slid in the horizontal direction through the link mechanism by lowering the operating member, the mechanism for moving the slide plate is complicated, thereby bringing about an increase in number of components; making it difficult to manufacture the socket; and increasing the manufacture cost.

Another problem is as follows: One of the resilient pieces of the contact pin is opened out, whereby each of the terminals of the electric part is clamped by the resilient pieces, and each of the terminals of the electric part is supported at the two points. For this reason, the stability of contact of the contact pins with the terminals is poor.

SUMMARY OF THE INVENTION

Accordingly, it is an object of the present invention to provide a socket for an electric part, in which the slide plate can be moved by a simple structure, and which can be manufactured easily and at a lower cost, wherein the stability of contact of the contact pins with the terminals can be enhanced.

To achieve the above object, according to a first aspect and feature of the present invention, there is provided a socket for an electric part, comprising a plurality of contact pins disposed on a socket body and capable of being brought into and out of contact with terminals of the electric part, and a slide plate disposed on the socket body, so that tip ends of the contact pins are opened and closed to come into and out of contact with the terminals of the electric part by moving the slide plate by an operating member, wherein the slide plate includes contact pin-operating portions provided thereon for opening the contact pins, and operating grooves defined therein and each having a tapered face, and the operating member includes operating arms disposed thereon and adapted to be engaged into the operating grooves in the slide plate, so that the operating arms urge the tapered faces of the operating grooves by urging the operating member downwards, thereby directly moving the slide plate.

With the above arrangement of the first feature, the slide plate is moved directly by urging the tapered faces of the operating grooves by the operating arms by urging the operating member downwards, and the tip ends of the contact pins are opened by the movement of the slide plate. Therefore, the mechanism for moving the slide plate is extremely simple; the number of components can be reduced substantially; and the socket can be manufactured easily and at a lower cost. Further the socket is of such a simple structure that the slide plate is moved by the operating arms of the operating member and the tapered faces of the operating grooves in the slide plate. Therefore, the plurality of operating arms of the operating member and the plurality of operating grooves in the slide plate can be provided easily, whereby the slide plate can be moved stably.

According to a second aspect and feature of the present invention, in addition to the first feature, each of the contact pins is comprised of three resilient pieces: two movable resilient pieces and a single stationary resilient piece, the movable resilient pieces being capable of being opened in such directions that they are spaced apart from each other.

With the above arrangement of the second feature, each of the contact pins is comprised of three resilient pieces: the two movable resilient pieces and the single stationary resilient piece, the movable resilient pieces being capable of being opened in such directions that they are spaced apart from each other. Each of the terminals of the electric part is supported at the three points. Therefore, the stability of contact of the contact pins with the terminals can be enhanced remarkably.

According to a third aspect and feature of the present invention, in addition to the second feature, each of the movable resilient pieces has an inclined guide face formed thereon, and each of the contact pin-operating portions is a :contact pin-operating bore having an inclined face forced therein and adapted to abut against the inclined guide face, so that the movable resilient pieces are opened in a direction perpendicular to a direction of movement of the slide plate by urging the inclined guide face by the contact pin-operating bore by the movement of the slide plate.

With the above arrangement of the third feature, the movable resilient pieces of each of the contact pins are opened in a direction perpendicular to a direction of movement of the slide plate by urging the inclined guide face by the contact pin-operating bore by the movement of the slide plate. Therefore, the movable resilient pieces of each of the contact pins can be opened easily and stably.

The above and other objects, features and advantages of the invention will become apparent from the following description of the preferred embodiment taken in conjunction with the accompanying drawings.

DESCRIPTION OF THE PREFERRED EMBODIMENTS

The present invention will now be described by way of an embodiment with reference to FIGS. 1 to 11.

Figure 1:
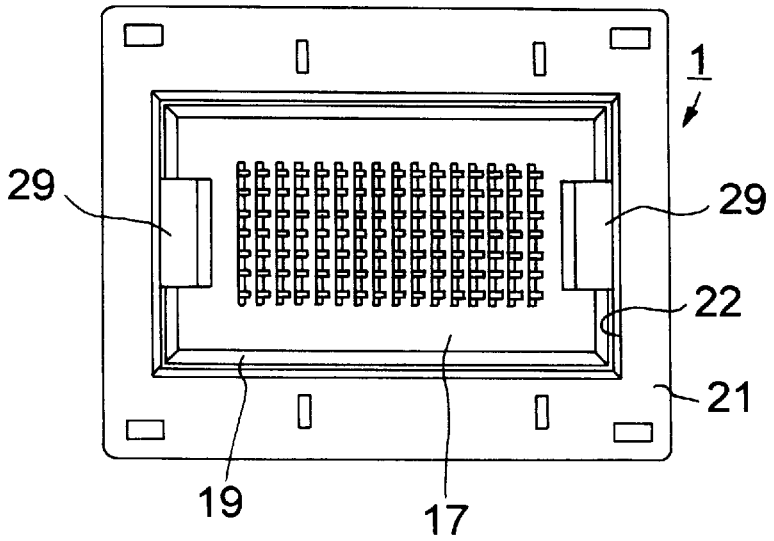
FIG. 1 is a plan view of an embodiment of a socket for an electric part according to the present invention.
Figure 2:
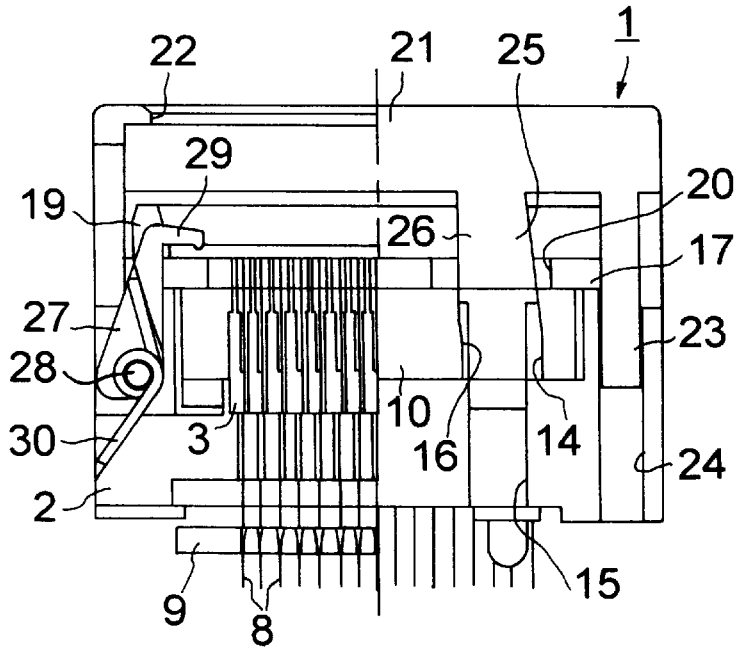
FIG. 2 is a semi-sectional front view of the socket shown in FIG. 1.

A socket 1 for an electric part according to an embodiment of the present invention shown in FIGS. 1 and 2 is adapted to electrically connect solder balls arranged as terminals of an electric part (not shown) of a measurer such as an IC package in a lattice fashion and an external electric test circuit (not shown) in order to carry out a performance test of the electric part.

The socket 1 for the electric part has a socket body 2 mounted on the external electric test circuit, and a plurality of contact pins 3 are arranged in a lattice fashion on the socket body 2 to correspond to the solder balls of the electric part.

Figure 5:
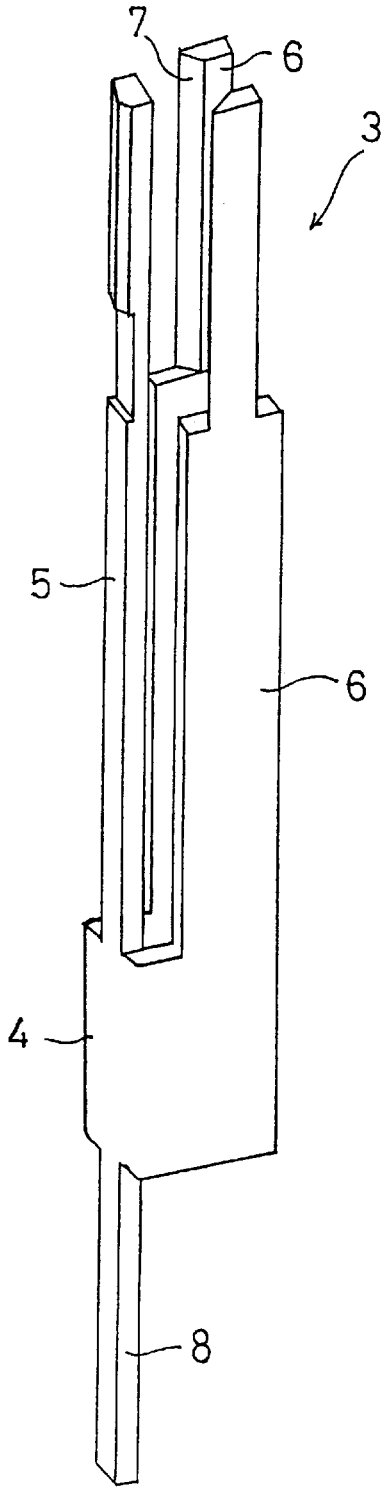
FIG. 5 is a perspective view of a contact pin used in the socket for the electric part shown in FIG. 1.

Each of the contact pins 3 has a base portion 4 having a given sectional shape shown in FIG. 5 and made of a material having a conductivity. A stationary resilient piece 5 extends upwards from a central portion of the base 4. A pair of movable resilient pieces 6, 6 extend upwards from opposite sides of the base portion 4, respectively, so that each of the movable resilient pieces 6 can be flexed in such spacing-apart directions. Further, an inclined guide face 7 is formed on that side of a tip end portion of each of the movable resilient pieces 6, which adjoins the stationary resilient piece 5. A single solder tail portion 8 is integrally formed at the central portion of the base 4 to extend downwards.

The contact pin 3 is retained in a righted state relative to the socket body 2 by press-fitting the solder tail portion 8 into the socket body 2, and the solder tail portions 8 protruding downwards from the socket body 2 further protrude downwards through a locating board 9, as shown in FIG. 2. Lowermost ends of the solder tail portions 8 are adapted to be connected to the printed wiring board by inserting them through through-bores (not shown) in the printed wiring board and soldering them to the printed wiring board.

A slide plate 10 is disposed on an upper surface of the socket body 2, and is provided with contact pin-insertion bores 11 through which the stationary resilient pieces 5 of the contact pins are passed, and contact pin-operating bores 12 through which the movable resilient pieces 6 are inserted. An inclined face 13 is formed in each of the contact pin-operating bores 12 to abut against the inclined guide face 7 of the contact pin 3. Thus, the contact pin-operating bores 12 are moved by moving the slide plate 10, thereby opening movable resilient pieces 6 of each of the contact pins 3 in such directions that they are spaced apart from each other in a direction perpendicular to a direction of movement of the slide plate 10.

An operating groove 14 is defined in each of opposite sides of the slide plate 10 to extend vertically, and a guide groove 15 is defined in each of opposite sides of the socket body 2 at a location corresponding to the operating groove 14 in the slide plate 10 with a width dimension slightly smaller than that of the operating groove 14. An inner side of the operating groove 14 is a tapered face 16 which is formed in an inclined manner, so that the widthwise position is displaced vertically.

Figure 6:
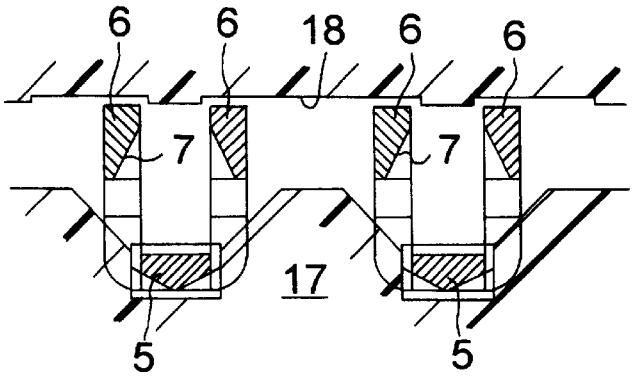
FIG. 6 is a plan view showing a top plate portion with the contact pins closed according to the present invention.
Figure 7:
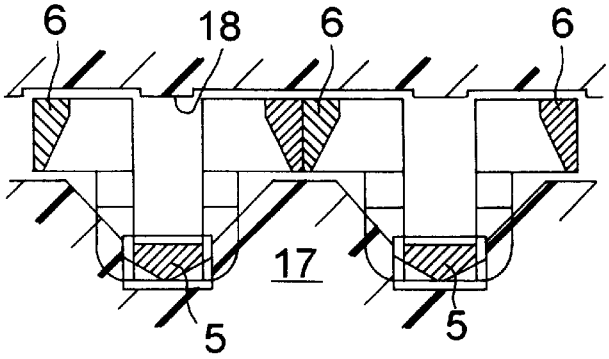
FIG. 7 is a plan view of the top plate portion with the contact pins opened according to the present invention.
Figure 8:
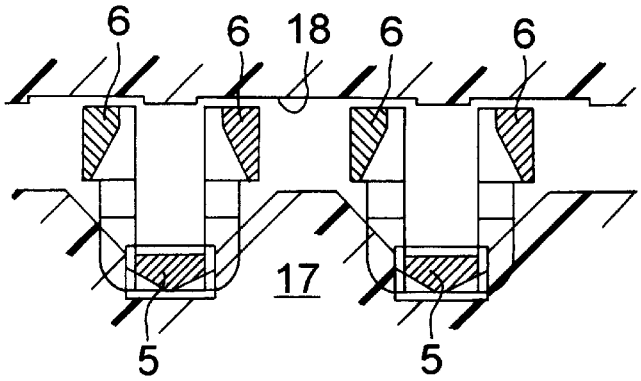
FIG. 8 is a plan view of the top plate portion with solder balls clamped by the contact pins according to the present invention.

Further, a top plate 17 is disposed on an upper surface of the slide plate 10, so that an electric part may be placed on an upper surface thereof. Support openings 18 are defined in the top plate 17, as shown in FIGS. 6 to 8, and upper ends of the contact pins 3 are inserted through the openings 18. A guide 19 is mounted around the top plate 17 for positioning the electric part at a predetermined location, as shown in FIG. 1. A relief groove 20 is defined in each of opposite sides of the top plate 17 at a location corresponding to the operating groove 14 in the slide plate 10 with. a width dimension larger than that of the operating groove 14, as shown in FIG. 2.

Further, an operating member 21 is vertically movably disposed above the top plate 17 and has an opening 22 defined therein at a size enough to permit the electric part to be insert into the opening 22. Guide arms 23 are provided at four corners of the operating member 21 to protrude downwards, so that the operating member 21 can be guided vertically by bringing the guide arms 23 into engagement in cover guide grooves 24 defined in the outer side of the socket body 2. The operating member 21 is biased by a biasing member (not shown) such as a spring or the like, so that it is always located in an upper position.

In the present embodiment, a downward extending operating arm 25 is projectingly provided on each of opposite sides of the operating member 21 at a location corresponding to the operating groove 14. An intermediate portion of the operating arm 25 is an operating portion 26 which is engaged in the operating groove 14 and formed with a slope for retracting the tapered face 16 of the operating groove 14 upwards on one side. A lower end of the operating arm 25 is formed at a width dimension slightly smaller than that of the operating portion 26, so that it may be engaged into the guide groove 15. Thus, the operating portion 26 of the operating arm 25 is brought into a sliding contact with the tapered face 16 of the operating groove 14 in the slide plate 10 by lowering the operating member 21, whereby the slide plate 10 can be moved laterally.

A pair of latches 27 are mounted to the socket body 2 on opposite sides of the top plate 17 for turning movement about a shaft 28. Each of tip ends of the latches 27 is a part-retaining portion 29 for retaining a peripheral edge of the electric part. Each of the latches 27 is biased by a biasing force of a spring 30 in such a direction that the part-retaining portion 29 is brought into contact with the upper surface of the top plate 17, so that each of the latches 27 is turned against the biasing force of the spring 30, whereby the part-retaining portion 29 is retracted from a position for disposition of the electric part.

The operation of the present embodiment will be described below.

Figure 9:
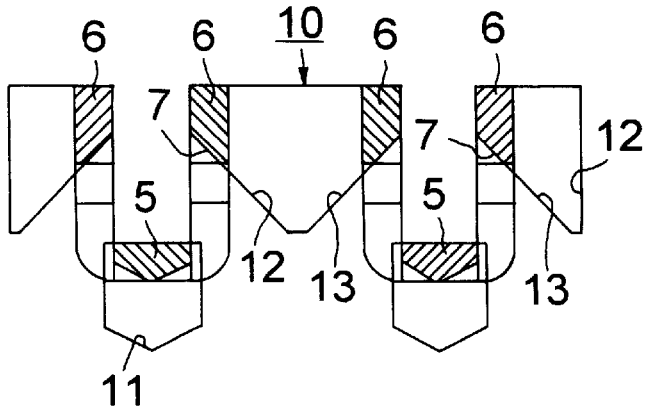
FIG. 9 is a plan view of the slide plate portion with the contact pins closed according to the present invention.

In a usual state, the operating member 21 is located in the upper position, and the tip end of each of the contact pins 3 is retained in a closed state, as shown in FIGS. 2, 6 and 9.

To mount an electric part to the socket 1 for the electric part from this state, the operating member 21 is pushed downwards, whereby the operating portions 26 of the operating arms 25 of the operating member 21 are brought into sliding contact with the tapered faces 16 of the operating grooves 14 in the slide plate 10, and the lower ends of the operating arms 25 are moved downwards, while being guided in the guide grooves 15. As the operating arms 25 is lowered, the operating portions 26 of the operating arms 25 urge the tapered faces 16 of the operating grooves 14, whereby the slide plate 10 is moved laterally.

Figure 10:
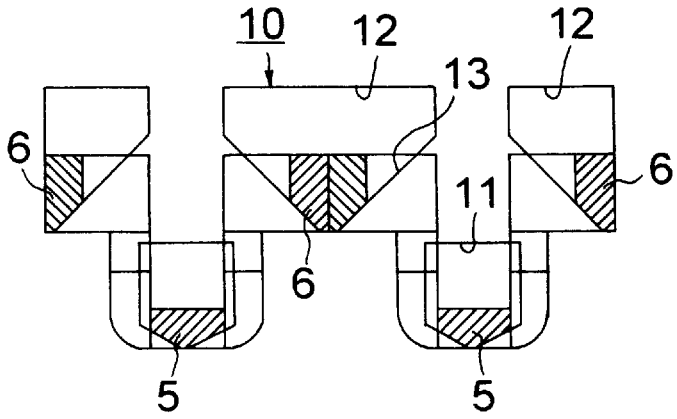
FIG. 10 is a plan view of the slide plate portion with the contact pins opened according to the present invention.
Figure 11:
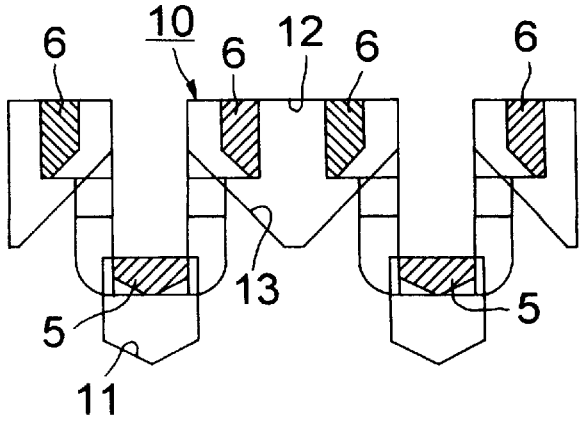
FIG. 11 is plan view of the slide plate portion with the solder balls clamped by the contact pins according to the present invention

As the slide plate 10 is moved laterally, the contact pin-operating bores 12 in the slideplate 10 area also moved, there by urging the inclined guide face 7 of each of the contact pins 3 abutting against the inclined face 13 of each of the contact pin-operating bores 12 to open the movable resilient pieces 6 of each of the contact pins 3, so that they are spaced apart from each other in a direction perpendicular to the direction of movement of the slide plate 10, as shown in FIGS. 7 and 10.

Figure 3:
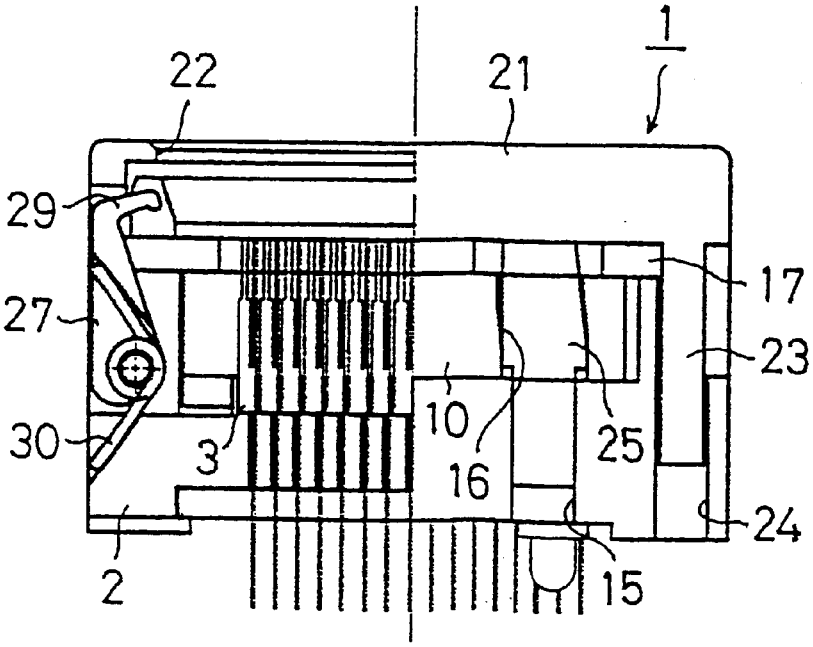
FIG. 3 is a semi-sectional front view of the socket shown in FIG. 1 in a state in which operating member has been urged.
Figure 4:
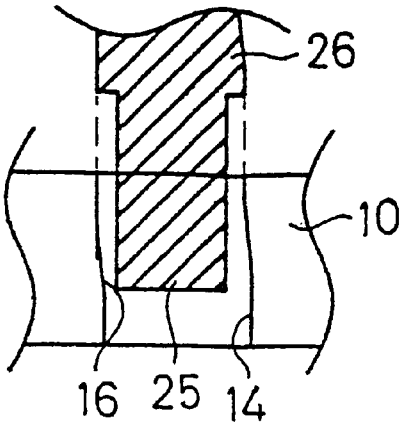
FIG. 4 is an enlarged view showing an operating groove portion in the socket for the electric part shown in FIG. 2.

At the same time, each of the latches 27 is turned against the biasing force of the spring 30 by the operating member 21, whereby the part-retaining portion 29 thereof is moved to its retracted position, as shown in FIG. 3.

In this state, the electric part is guided on the guide portions 19 and placed at the predetermined location on the upper surface of the top plate 17, whereby the solder balls of the electric part are inserted in a non-contact state between the opened tip ends of the contact pins 3.

When the upward urging force on the operating member 21 is then released, the operating member 21 is lifted under the action of the biasing force of the biasing member, whereby the slide plate 10 is moved laterally back to its original position, and the latches 27 are turned under the action of the biasing force of the spring 30. Thus, the peripheral edge of the electric part is retained by the part-retaining portions 29.

On the other hand, when the slide plate 10 is returned to its original position, the urging force on the movable resilient pieces 6 of each of the contact pins 3 is released, whereby the movable resilient pieces 6 are returned to their original positions. In this manner, the solder balls of the electric part are clamped by the tip ends of the movable resilient pieces 6 and the tip end of the stationary resilient piece 5, as shown in FIGS. 8 and ll. Thus, the solder balls of the electric part are electrically connected to the printed wiring board through the contact pins 3.

To remove the electric part from the mounted state, the operating member 21 is likewise lowered, thereby opening the tip ends of the contact pins 3. This causes the solder balls of the electric part to be disengaged from the contact pins 3, whereby the electric part can be removed easily by a weaker force.

Therefore, in the present embodiment, the operating member 21 is lowered downwards, whereby the operating portions 26 of the operating arms 25 of the operating member 21 urge the tapered faces 16 of the operating grooves 14 to move the slide plate 10 directly in the lateral direction. Therefore, the mechanism for moving the slide plate 10 is extremely simple and hence, the number of components can be reduced substantially and the socket 1 can be manufactured at a lower cost. Further, the socket 1 is of such a simple structure that the slide plate 10 is moved by the operating arms 25 of the operating member 21 and the tapered faces 16 of the operating grooves 14 in the slide plate 10. Therefore, the plurality of operating arms 25 of the operating member 21 and the plurality of operating grooves in the slide plate 10 can be provided easily, whereby the slide plate 10 can be moved stably.

Each of the contact pins 3 is comprised of the stationary contact piece and the two movable contact pieces, so that each of the solder balls 3 of the electric part is supported at the three points. Therefore, the stability of contact of the contact pins 3 and the solder balls can be enhanced remarkably.

Although the embodiments of the present invention have been described in detail, it will be understood that the present invention is not limited to the above-described embodiments, and various modifications in design may be made without departing from the spirit and scope of the invention defined in claims.

What is claimed is:

1. A socket for an electric part, comprising a plurality of contact pins disposed on a socket body extending in a vertical direction and capable of being brought into and out of contact with terminals of the electric part and a slide plate disposed on the socket body and movable in a lateral direction so that tip ends of said contact pins are opened and closed to come into and out of contact with the terminals of the electric part by moving said slide plate in said lateral direction by an operating member, wherein said slide plate includes contact pin-operating portions provided thereon for opening said contact pins, and operating grooves defined therein and each having a tapered face, and said operating member includes operating arms disposed thereon and engaging into said operating groves in said slide plate, so that said operating arms urge the tapered faces of said operating grooves by urging said operating member downwards, thereby directly moving said slide plate, each of said contact pins is comprised of three resilient pieces: two movable resilient pieces and a single stationary resilient piece, said movable resilient pieces being capable of being opened in such directions that they are spaced apart from each other, each of said movable resilient pieces has an inclined guide face formed thereon, and each of said contact pin-operating portions is a contact pin-operating bore having an inclined face forced therein and abutting against said inclined guide face, so that said movable resilient pieces are opened in a direction perpendicular to a direction of movement of the slide plate by urging said inclined guide face by said contact pin-operating bore by the movement of said slide plate.

* * * * *